United States Patent [19]

Nelson et al.

[11] Patent Number: 4,513,963

[45] Date of Patent: Apr. 30, 1985

[54] WEIGHTED EXERCISING DEVICE

[76] Inventors: Bradley B. Nelson, 1105 6th Ave. NW; Gregory T. Nelson, 2228 Central West, both of Great Falls, Mont. 59404

[21] Appl. No.: 464,786

[22] Filed: Feb. 9, 1983

[51] Int. Cl.[3] ..... A63B 21/00

[52] U.S. Cl. ..... 272/128; 272/DIG. 4; 272/117

[58] Field of Search ..... 272/117, 122, 123, 126, 272/143, DIG. 4, 93, 128

[56] References Cited

U.S. PATENT DOCUMENTS

| | | | |
|---|---|---|---|
| 793,101 | 6/1905 | Schmidt | 272/122 |
| 825,955 | 7/1906 | Bohache | 272/128 X |
| 1,013,782 | 1/1912 | Koch | 272/122 |
| 2,046,653 | 7/1936 | Petcoff | 272/93 |
| 3,550,312 | 12/1970 | East | 272/128 X |
| 3,904,198 | 9/1975 | Jones | 272/128 X |
| 4,043,553 | 8/1977 | Juarez | 272/128 |
| 4,252,316 | 2/1981 | Price | 272/DIG. 4 |
| 4,360,198 | 11/1982 | Waulters | 272/117 |
| 4,369,968 | 1/1983 | Price | 272/123 |

FOREIGN PATENT DOCUMENTS

| | | | |
|---|---|---|---|
| 966866 | 4/1975 | Canada | 272/122 |
| 249890 | 5/1948 | Switzerland | 272/128 |

*Primary Examiner*—Richard J. Apley
*Assistant Examiner*—William R. Browne
*Attorney, Agent, or Firm*—Arthur L. Urban

[57] ABSTRACT

Body exercise apparatus includes a tubular member having a length significantly greater than the width of a person's shoulders with bearings disposed within the tubular member adjacent the ends thereof. A bar member is disposed within the tubular member along the axis thereof, the ends of the bar member extending through and beyond the bearings and connector sections associated with the exposed end sections of the bar member. Each of the connector sections includes at least one opening, the opening being of a size slightly larger than the cross section of the exposed bar member end section. A weight is permanently affixed adjacent the opposite end of each connector section, the exposed bar member end section being engageable with the connector section opening. A fastener secures each connector section to an exposed bar member end section in an orientation substantially perpendicular to the tubular member, and a protective covering is disposed over the weight, the connector sections and at least a portion of the tubular member.

7 Claims, 4 Drawing Figures

WEIGHTED EXERCISING DEVICE

This invention relates to a novel exercise apparatus and more particularly relates to a new apparatus which can be used in a number of different exercises.

People have been exercising their bodies throughout the history of man. Originally, the activities and tasks that persons normally performed exercised their bodies. People had to walk from one place to another, to kill animals for food with primitive weapons and had to build their own shelters. All of these tasks involved a great deal of bodily effort. The physical exertion of these activities maintained the muscles of the body in good condition.

With the development of society and the industrial revolution, manufacturing facilities attracted people for employment. Many of the jobs in manufacturing facilities were organized on an assembly line basis in which the product moved from one job station to another during the assembly process. Commonly, each employee performed a single step in the assembly such as adding a component or tightening previously added components. Thus, many of the jobs involved a minimum of physical exertion.

One result of such limited physical activity on the job was that the condition of the bodies of individuals suffered. However, their personal time continued to involve considerable physical activity. People still needed to obtain fuel for cooking and heating. In addition, much food was raised by each family and this required considerable physical activity. Thus, personal activities continued to provide sufficient physical exertion to maintain a person's body in good condition.

In recent years, society has become so developed that people not only do not have physical activity in their jobs, but also their private lives do not require any great amount of physical activity to take care of their daily needs. The many appliances which are now available enable families to do household tasks more easily and quickly with a minimum of exertion. Also, the many power tools and machinery allow yard work and maintenance to be performed efficiently with a minimum of effort. In addition, most families now have fuel sources available automatically and do not have to collect their own fuel supplies.

Another contributing factor is the reduction in the number of hours worked by employees. This increased leisure time causes people to pursue recreational activities. Since a large proportion of the population live in apartments or houses on small lots in large cities, their living conditions make it extremely difficult to find opportunities for recreation involving physical exertion, except on infrequent vacations or weekends away from the city.

The lack of regular physical exercise over a period of years has caused a significant deterioration in the physical condition of the population at large. The limited physical activity together with excessive amounts of high calorie and high cholesterol foods is believed by many to have produced the great increase in the incidence of heart attacks, strokes and similar disabling or fatal diseases.

As people became aware of the health hazards of their sedentary life styles, a significant proportion of the population has made changes in their life style in an attempt to reduce the risk of such diseases striking them.

One major change has been the great increase in activities providing physical exertion.

Many people go on diets to eliminate foods that could lead to health problems. Some people started exercise programs. More recently, the benefits of running have been widely publicized and a large part of the population has started to jog. Also, health clubs have become very popular as vehicles for improving the physical fitness of the body.

Although these body conditioning expedients have provided a significant improvement in the physical condition of the population as a whole, they do not provide an ideal solution for many persons. Some people have difficulty sticking to an exercise program that is sufficiently varied to achieve the required improvement in body condition. Other persons cannot jog regularly due to adverse weather conditions or the like. Still others find visits to health clubs costly and time-consuming. Also, at health clubs, it may be necessary to wait your turn to use the equipment.

One exercise expedient that is increasing in popularity is the home exercise unit. Exercising at home overcomes many of the problems associated with health clubs. One device proposed for home use is disclosed in U.S. Pat. No. 3,756,597. The device utilizes a pair of rotating weight members on the ends of a connecting shaft. The shaft is gripped with the hands and the weight members rotated rapidly to provide the desired exertion.

While the principle set forth in the patent has merit, the device proposed is deficient in a number of respects. The swinging weight members may shift with respect to one another which may result in loss of control of the device and possible injury. Also, varying the weights requires the addition or removal of liquids or other flowable materials from a container. This can be time-consuming and require a high degree of care. Another potential problem is the possibility of the container developing a leak.

From the above discussion, it is apparent that present exercise expedients leave much to be desired for a great number of people. As a result, individuals continue to seek new ways to achieve the desired improvement in physical condition of the body.

The present invention provides a novel body exercise apparatus for personal use at home or in other private locations. The exercise apparatus of the invention provides a wide variety of different exercises. The weight means of the apparatus are maintained in proper orientation to insure control and safe use of the apparatus with a minimum of effort. The weight means can be varied when desired quickly and easily with a minimum of effort. Materials do not have to be added or removed to change the weights.

The exercise apparatus of the invention provides a unitary structure which is simple to use with a minimum of instruction. Since the weights can be varied easily, the apparatus is suitable for use by persons of all ages and strengths.

The exercise apparatus of the present invention is simple in design and relatively inexpensive. The apparatus can be fabricated from commercially available components and materials employing conventional metal working techniques and procedures.

These and other benefits and advantages of the novel exercise apparatus of the present invention will be apparent from the following description and the accompanying drawings in which.

Figure 1:
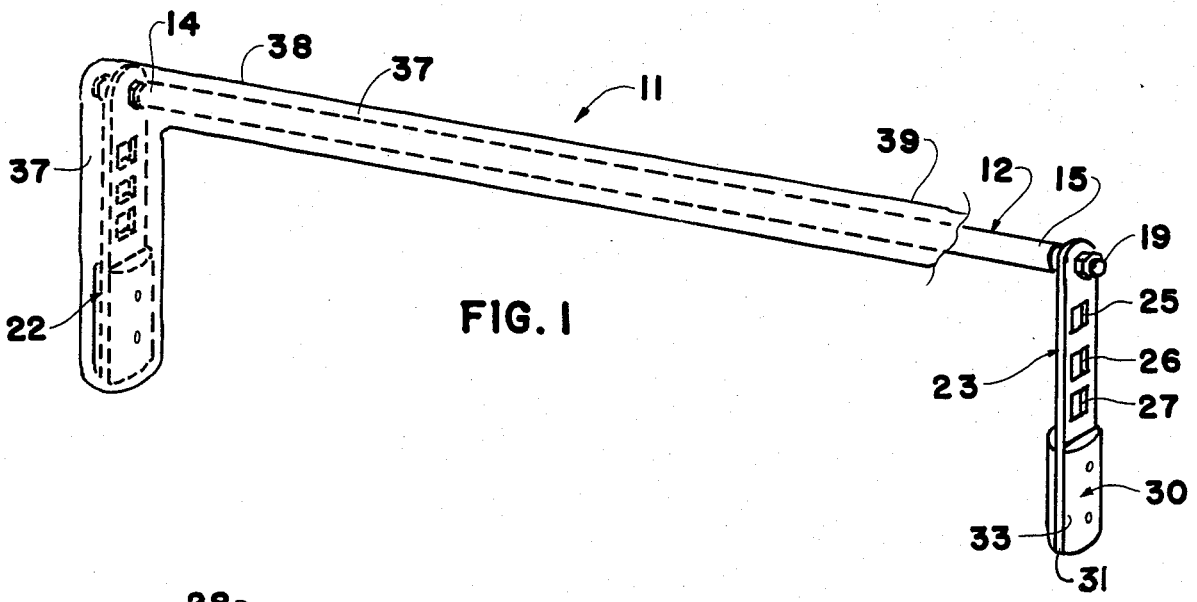
FIG. 1 is a view in perspective of one form of the body exercise apparatus of the invention.
Figure 2:
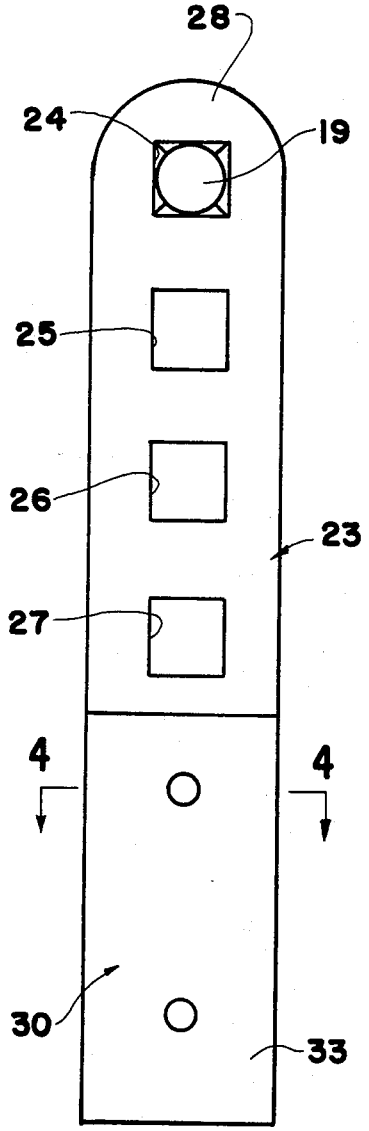
FIG. 2 is a right end view of the body exercise apparatus shown in FIG. 1.
Figure 3:
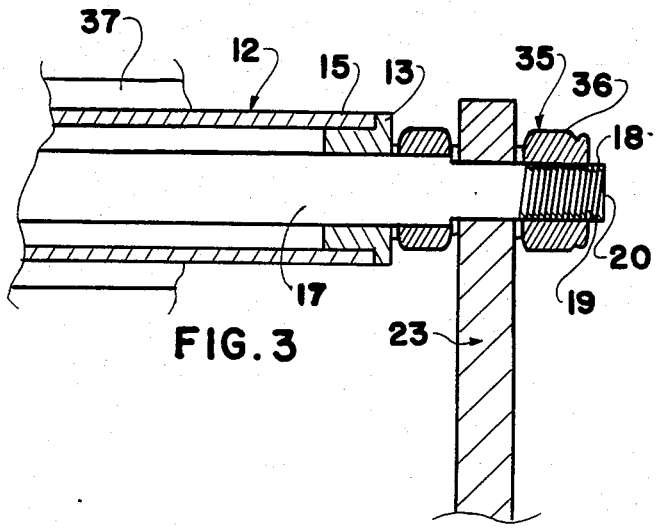
FIG. 3 is an enlarged fragmentary side view in section of the body exercise apparatus shown in FIG. 1.
Figure 4:
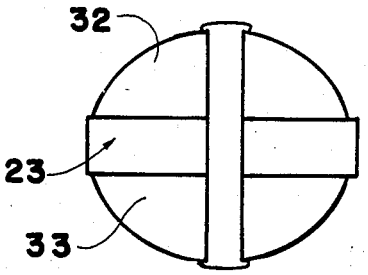
FIG. 4 is a sectional view of the body exercise apparatus of the invention shown in FIG. 2 taken along line 4—4 thereof.

As shown in the drawings, one form of the novel body exercise apparatus 11 of the present invention includes a tubular member 12 having a length significantly greater than the width of a person's shoulders. Bearing means 13 are disposed within the tubular member 12. The bearing means 13 are disposed adjacent the ends 14 and 15 of the tubular member.

A bar member 17 is disposed within the tubular member 12. The bar member is aligned with the axis of the tubular member. The ends 18 of the bar member 17 extend through and beyond the bearing means 13 to provide exposed end sections 19. Advantageously, the exposed bar member end sections 19 include threaded sections 20.

Connector sections 22 and 23 are associated with the exposed end sections 19 of the bar member 17. The connector sections 22 and 23 preferably are flat bar members.

Each of the connector sections 22 and 23 includes at least one opening 24 and preferably a plurality of spaced openings 24, 25, 26 and 27. The openings 24–27 extend along a portion of the length of the connector sections 22 and 23. Preferably, the openings are located toward one end 28 of the connector sections. Each of the openings 24–27 is of a size slightly larger than the cross section of the exposed bar member end sections 19.

Weight means 30 are permanently affixed adjacent the end 31 of each connector section opposite to the end 28 including the spaced openings. The weight means 30 preferably includes a pair of weight sections 32 and 33 affixed to opposite sides of the connector sections. Advantageously, the weight sections have generally semicylindrical cross sections.

The exposed end sections 19 of the bar member 17 are engageable with one of the openings 24–27 along the length of the connector sections 22 and 23. Preferably, means may be provided for orienting the connector sections with respect to one another such as openings with orientable configurations, e.g. square, hexagonal, etc. which mate with correspondingly shaped end sections 19.

Fastener means 35 secure each connector section 22 or 23 to an exposed end section 19, advantageously releasably. The connector sections are secured to the end sections in an orientation substantially perpendicular to the tubular member 12. The fastener means 35 preferably includes threaded nuts 36.

Protective covering means 37 is disposed over the weight means 30. The protective covering 30 advantageously also is disposed over connector sections 22 and 23 and over at least a portion of the tubular member 12. For example, grip portions 38 and 39 of the tubular member 12 may be covered. Preferably, the entire surface of the tubular member 12 is covered with the protective covering. Advantageously, the protective covering means 37 is a resilient means such as a foam.

The body exercise apparatus of the present invention may be formed of one or more materials. Suitable materials include metals such as steel, aluminum, etc., plastics, wood and combinations of such materials.

In the use of the body exercise apparatus 11 of the present invention, the connector sections 22 and 23 with weight means 30 affixed thereto are mounted on the bar member end sections 19. The corresponding opening 24–27 in each connector section is utilized in positioning the connector sections. The connector sections are oriented to extend from the tubular member 12 in the same direction and in the same plane. The connector sections are secured in place with fasteners 35 and the apparatus is ready for use.

The tubular member 12 is grasped near the ends thereof and the apparatus is lifted into a desired position with respect to the body. A typical exercise position involves the holding of the apparatus in front of the body either with arms extended or with the elbows close to the body.

The hands are moved in small circles causing the connector sections 22 and 23 to rotate. The extent to which the hands are moved controls the rotational velocity of the connector sections. As the rotational speed of the connector sections increases, the centrifugal force of the weight means on the ends of the connector sections increases. Thus, varying the speed of the rotation of the apparatus 11 changes the effective weight encountered by the user. To stop the rotation of the apparatus 11, the user simply slows the rotation of his hands which slows and then stops the rotation of the connector sections.

To achieve greater changes in the effective weight than can be achieved by changes in the speed of rotation, the position of the connector section with respect to the tubular member 12 can be changed by switching the mounting point of the connector section to a different opening 24–27 along its length. Thus, the apparatus provides a simple and quick means for changing the exercise effect of the apparatus in addition to changes caused by the varying of the speed of rotation.

The exercise apparatus of the invention can be employed in a large number of different exercises by changing the grip on the apparatus and the orientation and positioning of the apparatus with respect to the body. For example, the apparatus can be used with either one or two hands. Also, the body can be standing, lying down, squatting, etc. In addition, the apparatus can be held in front, above or behind the body.

The above description and the accompanying drawings show that the invention provides a novel exercise apparatus with features not present in devices previously or currently available. The apparatus of the invention is especially suitable for use in the home or other private locations. The apparatus can be utilized for a large number of different exercises.

The weights of the apparatus can be varied easily and quickly with a minimum of effort. Thus, the exercise apparatus is suitable for use by persons of all ages and strength capabilities. The apparatus can be used efficiently after only a minimum of instruction.

The exercise apparatus of the present invention is simple in design and relatively inexpensive. The apparatus can be fabricated from commercially available materials and components employing conventional metal working procedures. The apparatus is durable in construction and has a long useful life without maintenance.

It will be apparent that various modifications can be made in the particular exercise apparatus described in detail above and shown in the drawings within the scope of the invention. The size, configuration and arrangement of components can be changed to meet specific requirements. The fasteners for securing the connector sections can be common or special fasteners currently available. Also, the other protective coverings can be utilized. These and other changes can be made in the exercise apparatus provided the functioning and operation thereof are not deleteriously affected. Therefore, the scope of the invention is to be limited only by the following claims.

What is claimed is:

1. Body exercise apparatus including a tubular member having a length significantly greater than the width of a person's shoulders, bearing means disposed within said tubular member adjacent the ends thereof, a bar member rotatably disposed within said tubular member along the axis thereof, the ends of said bar member extending through is exposed and beyond said bearing means, flat bar connector sections including a plurality of spaced openings extending along the length thereof engageable with the exposed end sections of said bar member, each of said openings being of a mateable and orientable configuration the same as that of the cross section of said exposed bar member end section and slightly larger, weight means for offering resistance to a user during an exercise, said weight means being permanently affixed adjacent the opposite end of each connector section, said weight means including pairs of weight sections affixed to opposite sides of said connector sections, said exposed bar member end section being mateably engageable with one of said connector section openings, means for orienting said connector sections with one another, fastener means releasably securing each connector section to an exposed bar member end section in the same orientation with one another and substantially perpendicular to said tubular member, and covering means disposed over at least said weight means for protecting the apparatus; whereby changing the openings that engage said bar member end sections changes the effective force exerted as said weight means are rotated about said tubular member.

2. Body exercise apparatus according to claim 1 wherein said exposed bar member end sections include threaded sections.

3. Body exercise apparatus according to claim 1 wherein said weight sections have generally semi-cylindrical cross sections.

4. Body exercise apparatus according to claim 1 wherein said fastener means includes threaded nuts.

5. Body exercise apparatus according to claim 1 wherein said protective covering means is disposed over the entire surface of said tubular member.

6. Body exercise apparatus according to claim 1 wherein said protective covering material includes resilient means.

7. Body exercise apparatus according to claim 6 wherein said resilient material includes foam material.

* * * * *